US007152762B2

(12) United States Patent
Lang et al.

(10) Patent No.: US 7,152,762 B2
(45) Date of Patent: Dec. 26, 2006

(54) CONTROL VALVE

(75) Inventors: Damian L. Lang, Waterford, OH (US); Gregory A. Thieman, Waterford, OH (US)

(73) Assignee: E-Z Grout Corporation, Waterford, OH (US)

( * ) Notice: Subject to any disclaimer, the term of this patent is extended or adjusted under 35 U.S.C. 154(b) by 169 days.

(21) Appl. No.: 10/925,752

(22) Filed: Aug. 25, 2004

(65) Prior Publication Data

US 2006/0054645 A1 Mar. 16, 2006

(51) Int. Cl.
*B67D 5/06* (2006.01)
*G01F 11/00* (2006.01)

(52) U.S. Cl. ..... 222/185.1; 222/209; 222/214; 222/413; 222/504; 222/529

(58) Field of Classification Search ..... 222/185.1, 222/209, 212, 214, 413, 504, 529
See application file for complete search history.

(56) References Cited

U.S. PATENT DOCUMENTS

| | | | | |
|---|---|---|---|---|
| 2,681,751 | A * | 6/1954 | Stone et al. | 222/212 |
| 2,775,374 | A * | 12/1956 | Tamminga | 222/185.1 |
| 3,101,871 | A * | 8/1963 | Lucas et al. | 222/185.1 |
| 4,460,110 | A * | 7/1984 | Helander | 222/504 |
| 5,697,523 | A * | 12/1997 | Brandauer | 222/58 |
| 6,112,955 | A | 9/2000 | Lang | |
| 6,179,172 | B1 * | 1/2001 | Elder et al. | 222/504 |
| RE37,911 | E | 11/2002 | Lang | |

* cited by examiner

*Primary Examiner*—Joseph A. Kaufman
(74) *Attorney, Agent, or Firm*—Jason H. Foster; Kremblas, Foster, Phillips & Pollick

(57) ABSTRACT

A control valve for controlling the flow of fluent material from a machine, the machine having a frame including a hopper and a tube mounted to the hopper, an auger within the tube and a hose mounted to the tube. The control valve has a clamp, which has a first arm mounted to the frame on a first side of the hose and a second arm mounted to the frame on an opposite side of the hose. The first arm is movably mounted to the frame in a direction toward the hose. A prime mover is drivingly linked to the first arm and the frame for displacing the first arm toward the hose, thereby clamping the hose between the first and second arms for restricting the flow of fluent material through the hose.

17 Claims, 5 Drawing Sheets

CONTROL VALVE

CROSS-REFERENCE TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to a control valve and, more specifically, to a control valve for controlling the flow of fluent material from a machine having a frame including a hopper and a tube mounted to the hopper, the machine also having an auger within the tube and a hose mounted to the tube or any machine that delivers fluent material through a flexible-walled hose.

2. Description of the Related Art

In the construction field, it is typical to use a machine to pour mortar or slurry concrete into forms or hollow walls. A machine that is sold under the trademark GROUT HOG has a frame, a hopper with a tube and an auger, and a hose that extends from the discharge end of the tube. The auger is rotatably mounted inside the tube and a hose extends from the discharge end of the tube. In operation, a mortar or concrete slurry is poured into the hopper and then moved from the hopper through the tube by rotating the auger, and then out the hose in a controlled flow.

The operator of the hose directs the slurry to the desired location, such as within a concrete form. To stop the flow of the slurry, the operator of the hose must direct an operator of a forklift to which the machine is mounted to stop or reverse the hydraulic motor that drives the auger. In the meantime, slurry still flows from the hose into or around the form. It is not uncommon for the hose operator to try to kink the hose or stop the flow in some other manner, but this is not always effective since the hose is typically hard to handle due to the substantial weight of the large volume of mortar or slurry concrete within the hose.

It is possible to place a valve inside the machine described above, but a valve inside the machine will have problems. For example, a valve inside of the tube would be in direct contact with the fluent material, which deteriorates the parts of the valve rapidly. The valve may not work properly inside the tube because the fluent material used is typically slurry concrete or mortar, which, once dried, jams moving parts. This is not desirable since it may be difficult and time consuming to access the valve to clean or fix it.

Therefore, an object and feature of the invention is to provide a device for quickly stopping or limiting the flow of the fluent material from the hose. Additionally, an object and feature of the invention is to provide a flow control device that is easily accessed for cleaning and repair.

BRIEF SUMMARY OF THE INVENTION

The invention is a control valve for controlling the flow of fluent material from a machine having a frame including a hopper and a tube mounted to the hopper, and a hose mounted to the tube. In one embodiment, an auger is also mounted in the tube. The control valve has a clamp, which includes a first arm mounted to the frame on a first side of the hose and a second arm mounted to the frame on an opposite side of the hose. At least the first arm is movably mounted to the frame in a direction toward the hose. At least one prime mover is drivingly linked to the first arm and the frame for displacing the first arm toward the hose, thereby clamping the hose between the first and second arms for restricting the flow of fluent material through the hose.

Figure 1:
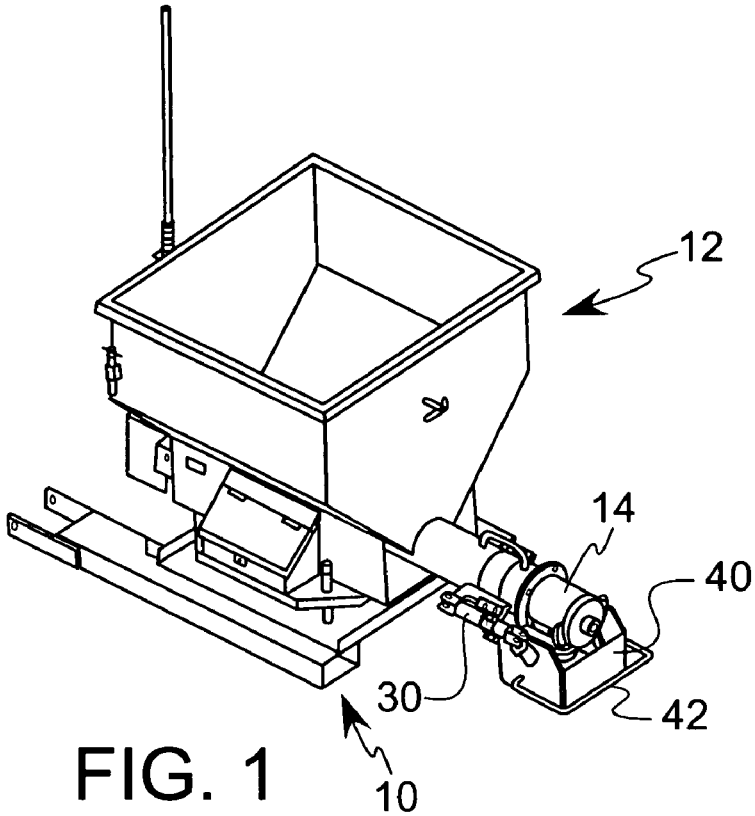
FIG. 1 is a view in perspective illustrating the preferred embodiment of the present invention.
Figure 2:
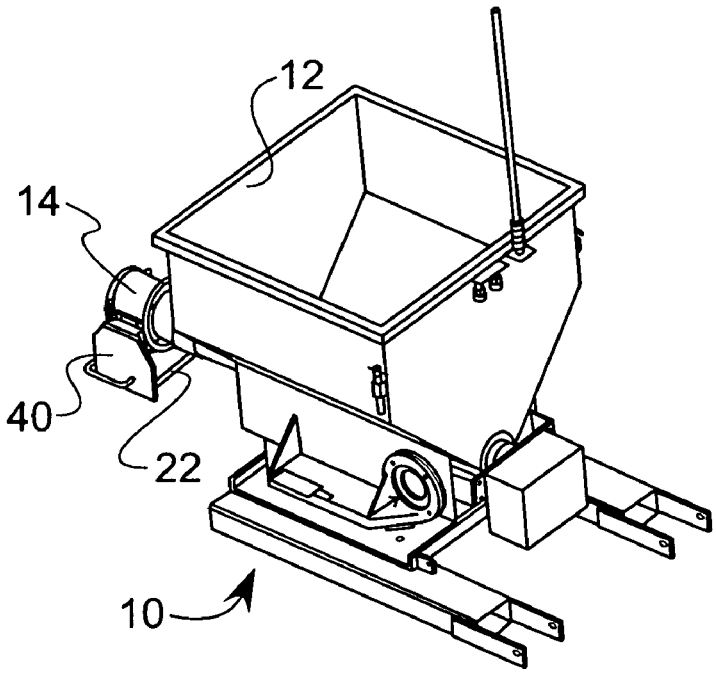
FIG. 2 is a rear view illustrating the preferred embodiment of the present invention.
Figure 3:
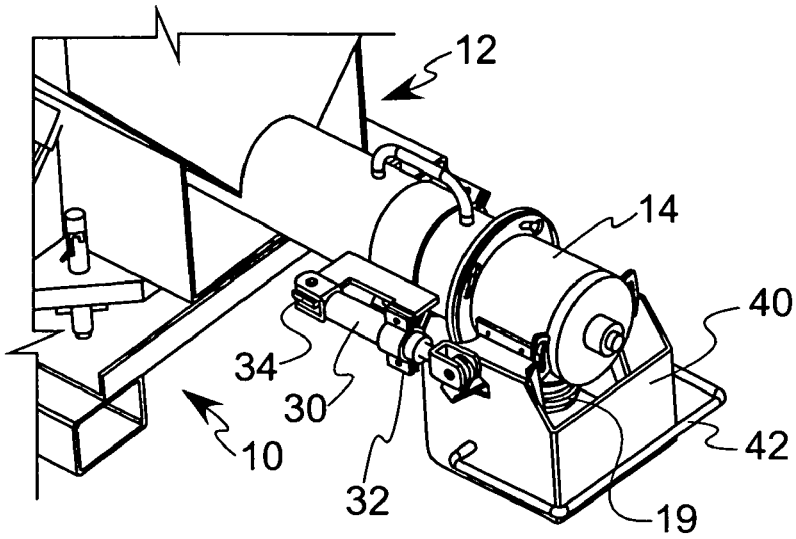
FIG. 3 is a close up view illustrating the preferred embodiment of the present invention.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents, which operate in a similar manner to accomplish a similar purpose. For example, the word connected or term similar thereto is often used. They are not limited to direct connection, but include connection through other elements where such connection is recognized as being equivalent by those skilled in the art.

DETAILED DESCRIPTION OF THE INVENTION

Figure 7:
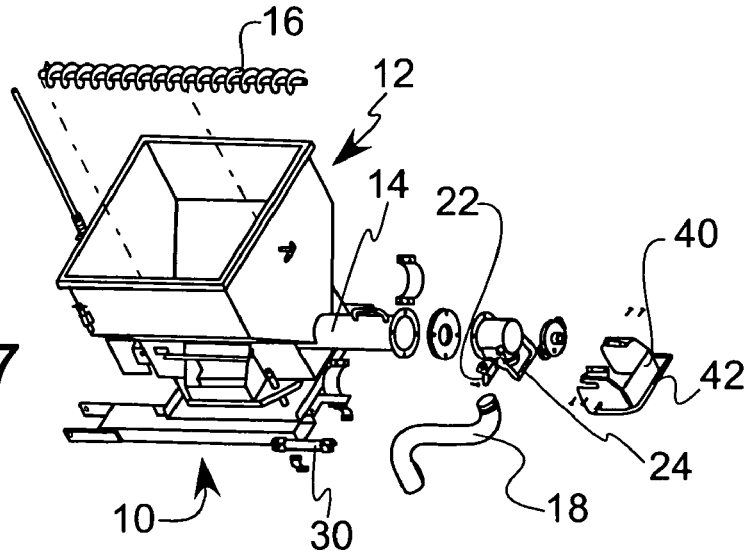
FIG. 7 is a schematic view illustrating the preferred embodiment of the present invention.

The preferred embodiment of the present invention is illustrated in FIG. 1 attached to a slurry-dispensing machine having a frame 10 including a hopper 12 and a tube 14 mounted to the hopper 12. An auger 16 is rotatably mounted within the tube (shown in FIG. 7) and a hose 18 is mounted to the tube 14. The hose 18 attaches to the hose base 19. Such a machine is shown in U.S. Pat. No. 6,112,955 and RE37,911E to Lang, which are incorporated herein by reference.

Figure 4:
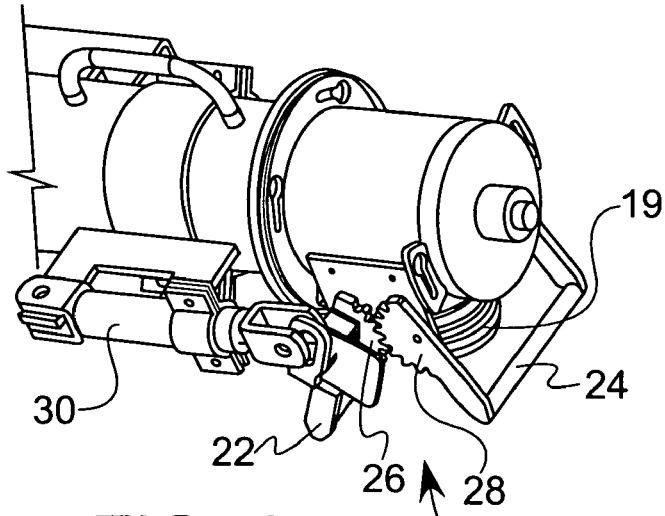
FIG. 4 is a view in perspective illustrating the embodiment in FIG. 1 without the housing.
Figure 6:
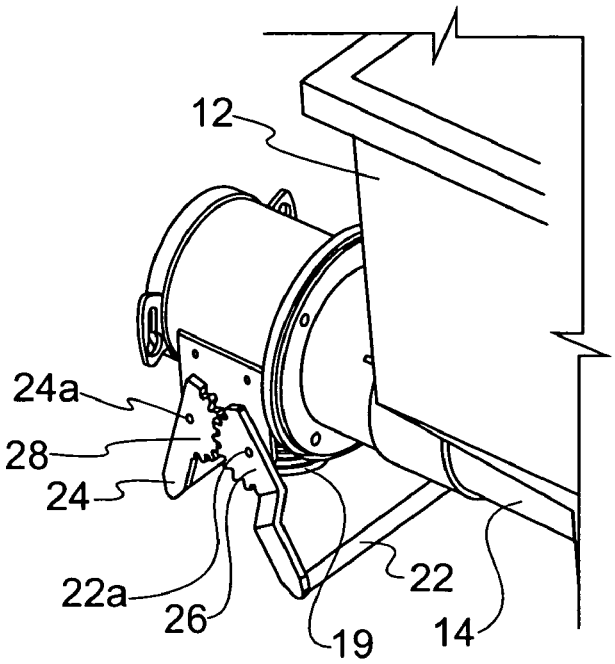
FIG. 6 is a rear view illustrating the embodiment in FIG. 4.

The control valve, which is the subject of the invention and is used in conjunction with a slurry-dispensing machine, has a clamp 20 (shown in FIG. 4), which has a first arm 22 mounted to the tube 14 on a first side of the hose 18 and a second arm 24 mounted to the tube 14 on an opposite side of the hose 18. In the preferred embodiment the first arm 22 and the second arm 24 are pivotably mounted by the pivot pins 22*a* and 24*a*, respectively, (see FIG. 6) to the tube 14 on the sides near the discharge end of the tube 14. As described below, when the arms 22 and 24 pivot toward the hose 18, the flow of material through the hose 18 is restricted. It will become apparent to a person of ordinary skill in the art that the arms 22 and 24 can be mounted in any variety of ways to any part of the frame 10, such as another part of the tube 14 or on the hopper 12.

Figure 5:
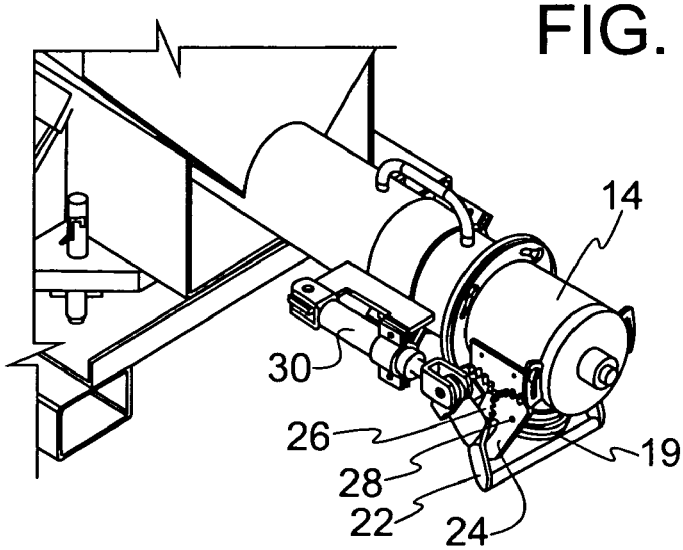
FIG. 5 is a view in perspective illustrating the preferred embodiment in a closed position.

The first arm 22 in the preferred embodiment is drivingly linked to the second arm 24 by intermeshing gears 26 and 28 (see FIG. 4) formed on each of the arms 22 and 24, respectively. These gears function to drivingly link the arms 22 and 24 together, much like a pair of conventional gears. Thus, upon pivoting of one arm toward the hose 18, the other arm pivots toward the hose, and vice versa. This driving link permits the arms 22 and 24 to be displaced from an open to a closed, flow restricting position. In the open position the fluent material can flow unrestricted through the hose 18, because the arms 22 and 24 are near the hose 18, but not blocking it by clamping or significantly constricting it. In the closed position, illustrated in FIG. 5 without the hose in place, the flow of material is restricted or stopped completely due to the arms 22 and 24 seating against the walls of the hose 18 and folding or pinching the hose 18 to constrict or close the passage through it.

In the preferred embodiment the arms 22 and 24 move simultaneously toward the hose 18 to clamp the hose 18. The arms 22 and 24 move along arcuate paths from the open position toward the hose 18 and clamp the hose 18 when closed. As will be apparent to a person of ordinary skill in the art, alternate arms can move along any path toward the hose 18 and are not restricted to an arcuate path. For example, arms could move in a line that is parallel to the tube 14, rather than along an arcuate path.

The preferred embodiment has at least one prime mover, such as the hydraulic ram 30, that is drivingly and pivotably linked to the first arm 22 near a first ram end 32 and to the frame 10 near a second ram end 34 for displacing the first arm 22 relative to the frame 10 and toward the hose 18. Movement of the arm 22 toward the hose 18 pivots the arm 24 toward the hose 18, and thereby clamps the hose 18 between the first and second arms 22 and 24 for restricting the flow of fluent material through the hose 18. Movement of the ram 30 in the opposite direction opens the clamp. In the preferred embodiment the hydraulic ram 30 is pivotably mounted to the first arm 22. Of course, a person of ordinary skill in the art will recognize that any other prime mover can be used to displace the arms 22 and 24.

Figure 9:
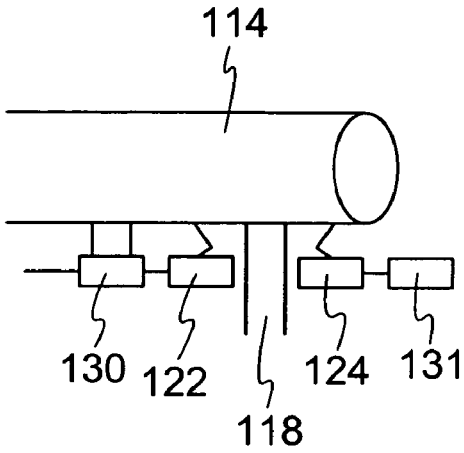
FIG. 9 is a schematic view illustrating an alternative embodiment of the present invention.

Although not preferred, it is possible to have a second prime mover 131, illustrated in FIG. 9, attached to the second arm 124 and to the frame 110 for displacing the second arm relative to the first arm 122. Additionally, a person of ordinary skill in the art will recognize that any number of prime movers can be used, and can be attached to both the first and second arms of the clamp.

Figure 8:
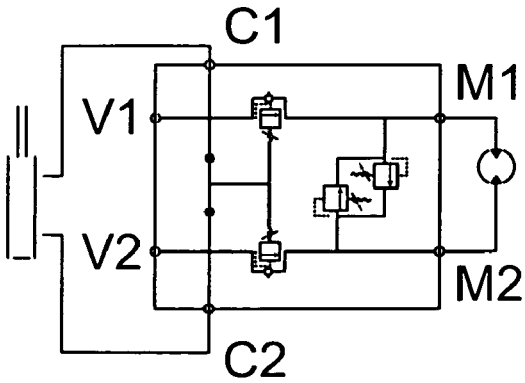
FIG. 8 is a schematic view illustrating the hydraulic circuit of the preferred embodiment of the present invention.

The hydraulic ram 30 has a power source, which can be a conventional forklift hydraulic pump (not shown) or an alternative driving device. The ram 30 is connected to the forklift pump by conventional hydraulic hoses (not shown) that extend from the hydraulic motor of the slurry-dispensing machine. The hydraulic ram 30 works like a conventional hydraulic ram wherein the hydraulic fluid is pushed through the hose to move the ram. The hydraulic fluid can flow in a direction that is reversed, which reverses the hydraulic ram. FIG. 8 illustrates the hydraulic circuit used in the preferred embodiment. The circuit shows the hydraulic pump, the hydraulic motor, the ram 30 and a sequence valve that actuates the ram 30 upon reversal of the hydraulic motor. The sequence valve is a well-known, conventional device.

A housing 40 is removably attached to the tube for covering the clamp 20. The housing 40 is preferably made of steel plate, but can be any variety of coverings that will protect the clamp 20. The housing 40 has a handle 42 that helps the operator of the machine to position the end of the tube 14 and the hose 18 during operation. The housing 40 protects the operator from getting a hand or other body part in between the arms 22 and 24 of the clamp 20 during operation. A person of ordinary skill will recognize that the housing 40, although preferred, is not necessary to the operation of the invention.

In operation, a forklift operator and a hose operator are positioned near their respective controls. The forklift operator operates the hydraulics and the position of the slurry-dispensing machine generally, while the hose operator moves the tube 14 and hose 18 to direct the fluent material to the desired location, such as a concrete form. The fluent material is in the hopper 12, and, once the auger 16 begins to rotate, is pumped through the tube 14. The fluent material flows from the hopper to the discharge end of the tube 14 and then through the hose 18 into the desired concrete form. Once the form is full, or the hose operator needs to move the hose 18, the flow of material through the hose 18 must be restricted or stopped. Clamping the hose with the arms 22 and 24 of the control valve slows or stops the flow of the fluent material.

To clamp the hose 18, the hose operator signals to the forklift operator to reverse the hydraulic motor, which reverses the rotating direction of the auger and actuates the hydraulic ram 30. As the hydraulic ram 30 is actuated, the first arm 22 is displaced in a direction toward the hose 18 as it pivots about its pivot pin 22*a*. Because of the intermeshing gears 26 and 28, the second arm 24 also pivots toward the hose 18 about its pivot pin 24*a*. The arms 22 and 24 rotate about the pivots in arcs and cease movement once the two arms 22 and 24 clamp the hose 18 in a flow-restricting position. This position can be short of completely closing off the hose 18, or by the arms aligning against the hose wall to pinch the hose closed. Preferably, the flow restricting position is when the clamp flattens the sidewalls of the hose 18 (one of the arms 24 is shorter than the other arm 22) and the shorter arm 24 nests within the longer and wider arm 24 and the hose is folded into a C or S shape between the arms.

To resume the flow of the fluent material through the clamped hose 18, the forklift operator resumes the normal direction of rotation of the hydraulic motor, which, due to the sequence valve, reverses the hydraulic ram 30. As the hydraulic ram 30 is reversed the first arm 22 is displaced in a direction away from the hose 18 while, due to the intermeshing gears 26 and 28, the second arm 24 is simultaneously displaced in a direction away from the hose 18. Both arms 22 and 24 pivot about the frame 10 in an arc until the two arms 22 and 24 are returned to their resting or open positions.

Figure 13:
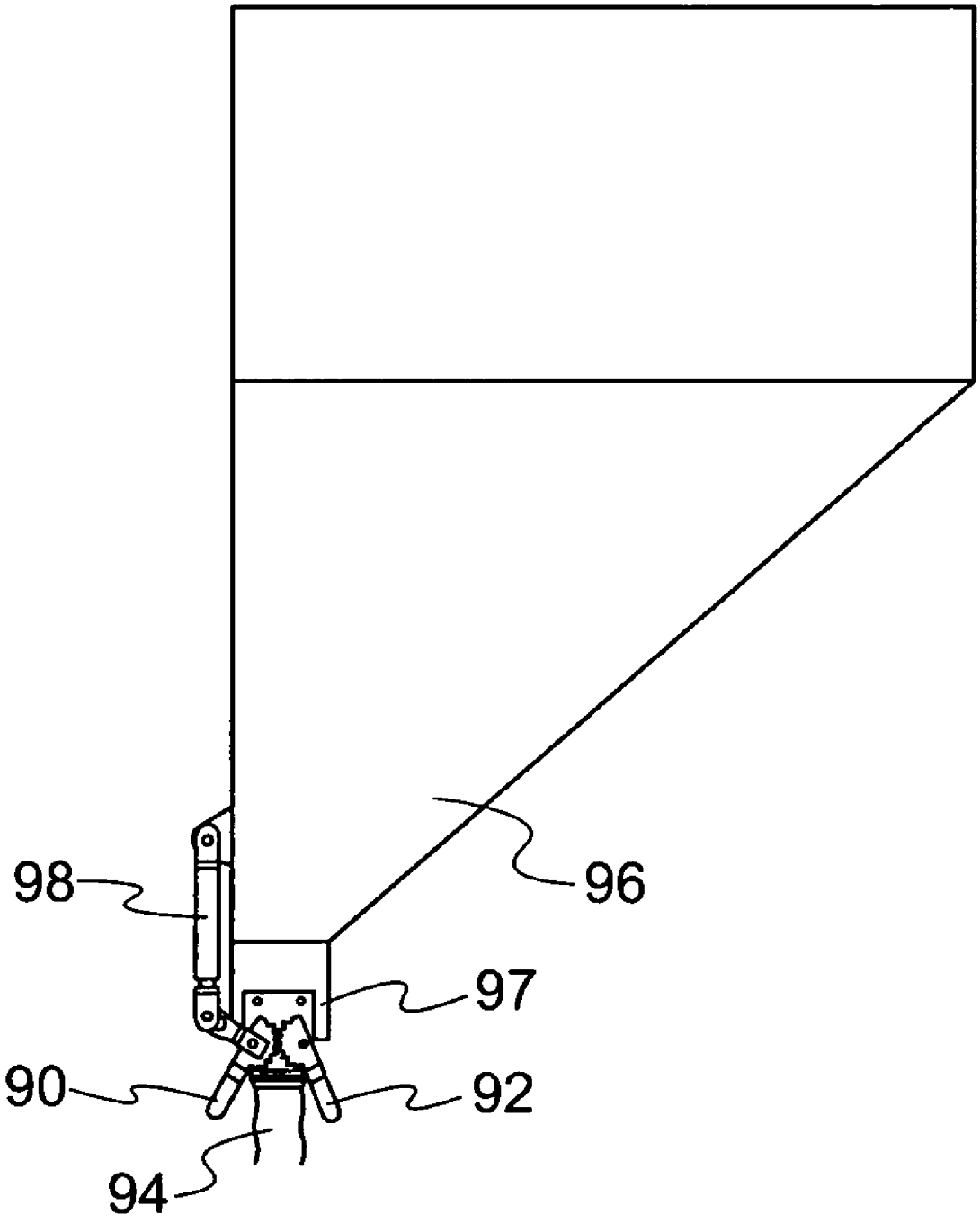
FIG. 13 is a schematic view illustrating an alternative embodiment of the present invention.

In an alternative embodiment, as illustrated in FIG. 13, the control valve is used with a hopper 96 without a rotatable auger to force the fluent material out of a tube 97. The fluent material in the hopper is fed by gravity out of the hopper through the tube 97 mounted thereto, and therefore an auger is not necessary. In this alternative, the clamp arms 90 and 92 are actuated by a hydraulic ram 98 to clamp the hose 94, stopping the flow of the fluent material from the hopper 96. The hydraulic ram 98 is reversed to open the arms 90 and 92. The tube 97 can be a circular cylinder or any cross-sectional shape.

Figure 10:
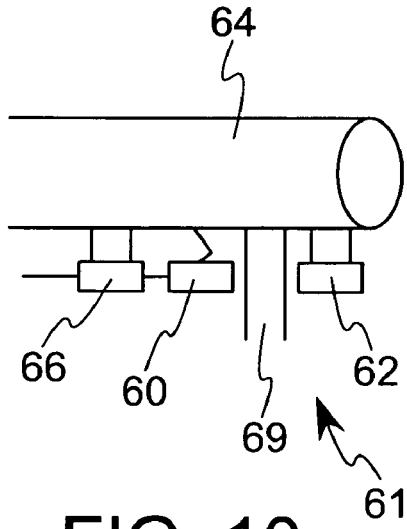
FIG. 10 is a schematic view illustrating an alternative embodiment of the present invention.

In an alternative embodiment, illustrated in FIG. 10, the first arm 60 of the clamp 61 is movable in a direction toward the hose 69 in a straight linear path. The second arm 62 of this embodiment is immovably attached to the tube 64. A second prime mover can be attached to the second arm 62 if the arm 62 is movable. In this embodiment, once the hydraulic ram 66 of the first arm 60 is actuated, the first arm 60 moves in a direction toward the hose 69. The first arm 60 ceases movement when the hose 69 is clamped between the first arm 60 and the second, stationary arm 62. The flow of the fluent material is restricted in this embodiment until the hydraulic ram 66 is reversed and the first arm 60 is moved in a direction away from the second, stationary arm 62.

Figure 11:
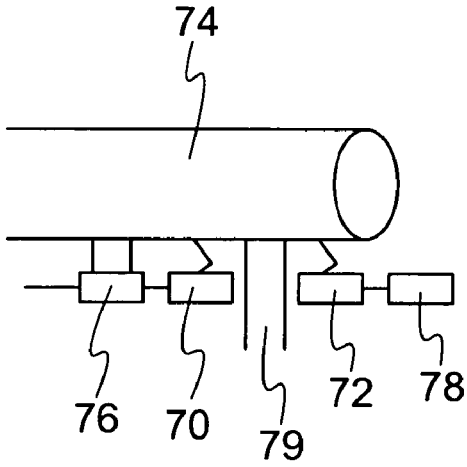
FIG. 11 is a schematic view illustrating an alternative embodiment of the present invention.

In a second alternative embodiment, illustrated in FIG. 11, the first arm 70 is moveable at a first predetermined rate, for example 5 feet per minute, toward the hose 79 and the second arm 72 is moveable at a second predetermined rate less than the first predetermined rate, such as 1 foot per minute, and is in a direction away from the hose 79. In this embodiment, a first prime mover 76 is attached to the first arm 70, while a second prime mover 78 is attached to the second arm 72. The arms 70 and 72 can thus move in the same direction, but at different rates, which accomplishes the clamping of the hose 79. To clamp the hose 79 the hydraulic rams 76 and 78 are actuated, which moves the first arm 70 toward the hose 79 and the second arm 72 away from the hose 79. The arms 70 and 72 cease movement when, due to the rate difference, the first arm 70 catches up with the second arm 72, and pinches the hose 79 into contact with the second arm 72 and the hydraulic ram 78 of the second arm 72 has reached its extreme position.

Figure 12:
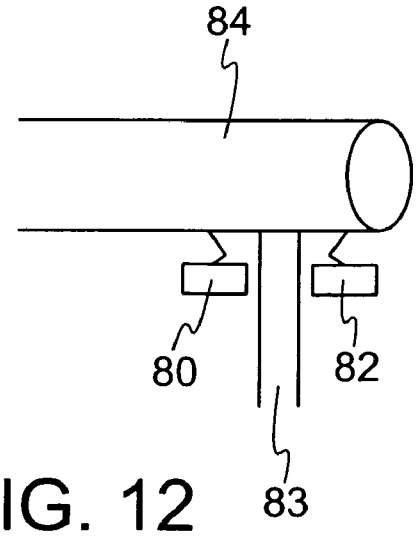
FIG. 12 is a schematic view illustrating an alternative embodiment of the present invention.

In a third alternative, illustrated in FIG. 12, the clamp may allow for manual operation of the arms 80 and 82. In this alternative, manual movement of the arms 80 and 82 of the clamp, such as by hand, replaces the prime mover. Here, the hose operator acts as the prime mover to open and close the arms 80 and 82 by his own force, not with a mechanical device. The hose operator, to restrict the flow of fluent material from the hose 83, pivots the arms 80 and 82 about the frame 84 manually in a direction toward the hose 83. To resume flow, the hose operator manually moves the arms 80 and 82 away from the hose 83 to their resting position.

While certain preferred embodiments of the present invention have been disclosed in detail, it is to be understood that various modifications may be adopted without departing from the spirit of the invention or scope of the following claims.

The invention claimed is:

1. A control valve for controlling the flow of fluent material from a machine having a frame including a hopper and a tube mounted to the hopper, the machine also having a hose mounted to the tube, the control valve comprising:

(a) a clamp having a first arm mounted to the frame on a first side of said hose and a second arm mounted to the frame on an opposite side of said hose, wherein at least the first arm is movably mounted to the frame;

(b) at least one prime mover drivingly linked to the first arm and the frame for displacing the first arm toward the hose, thereby clamping the hose between the first and second arms for restricting the flow of fluent material through the hose; and (c) a housing removably attached to said tube for covering the clamp wherein the machine has an auger within the tube, each of said arms is pivotably mounted to the tube, and the first arm is drivingly linked to the second arm by intermeshing gears on each of the arms for movement of the arms from an open position to a flow restricting position.

2. The control valve in accordance with claim 1, wherein said first arm is drivingly linked to said second arm for contemporaneous movement of the arms from an open position to a flow restricting position.

3. The control valve in accordance with claim 1, wherein said prime mover is pivotably attached to the first arm at a first prime mover end.

4. The control valve in accordance with claim 3, wherein said prime mover is a hydraulic ram.

5. The control valve in accordance with claim 4, wherein the prime mover has a power source.

6. The control valve in accordance with claim 5, wherein the power source is a forklift hydraulic motor.

7. The control valve in accordance with claim 1, further comprising a handle rigidly attached to the housing.

8. The control valve in accordance with claim 1, wherein said first and said second arms are moveable in a direction toward the hose.

9. The control valve in accordance with claim 8, further comprising a second prime mover attached to the second arm and the frame for displacing the second arm relative to the first arm.

10. A control valve for controlling the flow of fluent material front a machine having a frame including a hopper and a tube mounted to the hopper, the machine also having a hose mounted to the tube, the control valve comprising:

(a) a clamp having a first arm mounted to the frame on a first side of said hose and a second arm mounted to the frame on an opposite side of said hose, wherein at least the first arm is movably mounted to the frame; and (b) at least one prime mover drivingly linked to the first arm and the frame for displacing the first arm toward the hose, thereby clamping the hose between the first and second arms for restricting the flow of fluent material through the hose wherein the second arm is immovably attached to the frame and the first arm is moveable in a direction toward the hose.

11. A control valve for controlling the flow of fluent material from a machine having a frame including a hopper and a tube mounted to the hopper, the machine also having a hose mounted to the tube, the control valve comprising:

(a) a clamp having a first arm mounted to the frame on a first side of said hose and a second arm mounted to the frame on an opposite side of said hose, wherein at least the first arm is movably mounted to the frame; and (b) at least one prime mover drivingly linked to the first arm and the frame for displacing the first arm toward the hose, thereby clamping the hose between the first and second arms for restricting the flow of fluent material through the hose wherein said second arm is movably mounted to the frame, said first arm is moveable at a first predetermined rate and said second arm is moveable at a second predetermined rate, wherein the first predetermined rate is toward the hose, and the second predetermined rate is less than the first predetermined rate and is in a direction away from the hose.

12. The control valve in accordance with claim 11, further comprising a second prime mover attached to the second arm and the frame for displacing the second arm away from the first arm.

13. A control valve for controlling the flow of fluent material from a machine having a frame including a hopper and a tube mounted to the hopper, the machine also including an auger within the tube and a hose mounted to the tube, the control valve comprising:

(a) a clamp having a first arm pivotably connected to the tube near a first side of said hose and a second arm pivotably connected to the tube near an opposite side of said hose, wherein the first arm is drivingly linked to the second arm by intermeshing gears on each of the arms for movement of the arms from an open position to a flow restricting position; and (b) a prime mover pivotably mounted to the first arm near a first prime mover end and mounted to the frame near a second prime mover end for displacing the arms toward the hose and a housing removably attached to said tube for covering the clamp.

14. The control valve in accordance with claim 13, wherein said prime mover is a hydraulic ram.

15. The control valve in accordance with claim 14, wherein said prime mover has a power source.

16. The control valve in accordance with claim 15, wherein said power source is a forklift hydraulic motor.

17. The control valve in accordance with claim 13, further comprising a handle rigidly attached to the housing.

* * * * *